United States Patent [19]

Salerno

[11] 4,028,772

[45] June 14, 1977

[54] SLIDING DOOR SAFETY DEVICE

[75] Inventor: Michael T. Salerno, Oakland, N.J.

[73] Assignee: The Raymond Lee Organization, Inc., New York, N.Y. ; a part interest

[22] Filed: Apr. 26, 1976

[21] Appl. No.: 680,434

[52] U.S. Cl. ..... 16/86 A; 292/343; 109/63.5

[51] Int. Cl.[2] ..... E05F 5/02

[58] Field of Search ..... 16/86 R, 86 A, 86 C, 16/86 B, 83; 292/343; 109/63.5

[56] References Cited

UNITED STATES PATENTS

| | | | |
|---|---|---|---|
| 463,821 | 11/1891 | Wright | 16/83 |
| 896,242 | 8/1908 | Ralston | 16/83 |
| 1,649,339 | 11/1927 | Conley | 16/83 |
| 3,137,025 | 6/1964 | Howard | 16/83 |
| 3,141,188 | 7/1964 | Gray | 16/83 |
| 3,200,434 | 8/1965 | Jaruot | 16/86 A |
| 3,256,638 | 6/1966 | Ceyer et al. | 16/86 A |

*Primary Examiner*—Andrew V. Kundrat
*Attorney, Agent, or Firm*—Daniel Jay Tick

[57] ABSTRACT

A mounting device affixed to a sliding door frame supports a resilient ball in a manner whereby the ball is positionable in spaced relation with the door and the frame of the door when the door is closed thereby permitting the door to be securely closed and interposed between the door and frame when the door is open thereby preventing the door from closing, and protecting the fingers of unsuspecting people from being crushed between the door and the frame.

1 Claim, 4 Drawing Figures

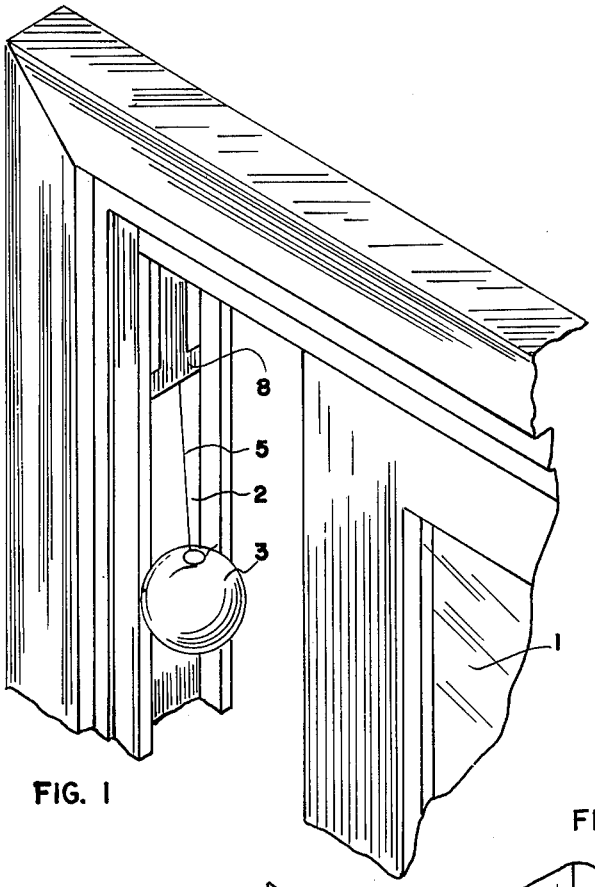
FIG. 1
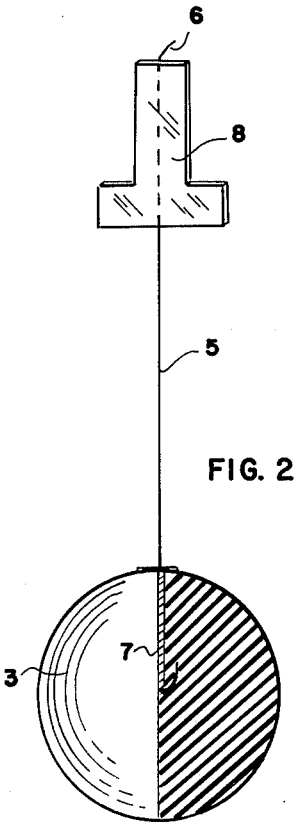
FIG. 2
FIG. 3
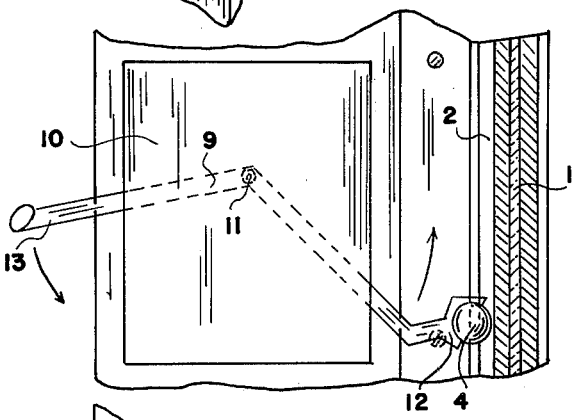
FIG. 4
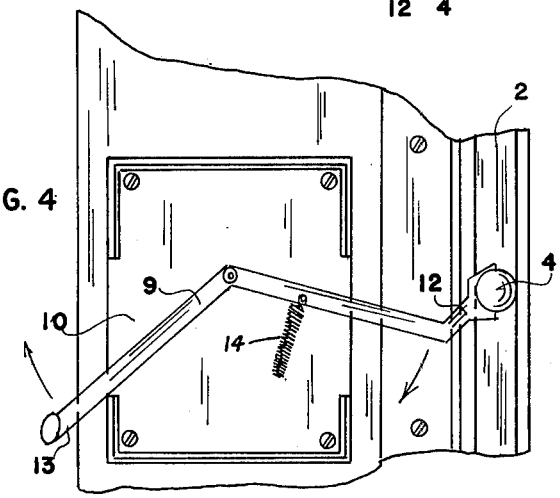

SLIDING DOOR SAFETY DEVICE

BACKGROUND OF THE INVENTION

The present invention relates to a sliding door safety device. More particularly, the invention relates to a sliding door safety device for a sliding door slidably mounted in a door frame having a track slidably accommodating the door.

Objects of the invention are to provide a sliding door safety device of simple structure, which is inexpensive in manufacture, installable with facility and convenience for use with new and existing sliding doors, used with facility and convenience, and functions efficiently, effectively and reliably to prevent the fingers of unsuspecting people, and especially children, from being crushed between the door and the frame when the door is suddenly closed.

BRIEF DESCRIPTION OF THE DRAWINGS

In order that the invention may be readily carried into effect, it will now be described with reference to the accompanying drawings, wherein:

FIG. 1 is a perspective view of an embodiment of the sliding door safety device of the invention;

FIG. 2 is a view, on an enlarged scale, partly in section, of the embodiment of FIG. 1;

FIG. 3 is a view, partly in section, of another embodiment of the sliding door safety device of the invention in position when the door is closed and secured; and FIG. 4 is a view of the embodiment of FIG. 3 in position when the door is open.

DETAILED DESCRIPTION OF THE INVENTION

The sliding door safety device of the invention is for a sliding door 1 (FIGS. 1 and 3) slidably mounted in a door frame 2 (FIGS. 1, 3 and 4) having a track (not shown in the FIGS.) slidably accommodating the door.

The safety device of the invention comprises a resilient ball 3 (FIGS. 1 and 2) or 4 (FIGS. 3 and 4) of any suitable material such as, for example, rubber.

In accordance with the invention, a mounting device is affixed to the door frame 2 and supports the ball 3 in a manner whereby the ball is positioned in spaced relation from the door and the frame when the door is closed, as shown in FIG. 3, thereby permitting the door to be securely closed, and is interposed between the door and the frame when the door is open, as shown in FIGS. 1 and 4, thereby preventing the door from closing and protecting the fingers of unsuspecting people, and especially small children, from being crushed between the door and the frame when the door is suddenly closed.

In the embodiment of FIGS. 1 and 2, a mounting device comprises an elastic string 5 of any suitable type such as, for example, rubber. The string 5 has spaced opposite first and second ends 6 and 7 (FIG. 2). The string 5 is affixed at its first end 6 to the frame 2 in the path of the door 1, as shown in FIG. 1. This may be accomplished by any suitable means such as, for example, adhesive tape 8. The string 5 is affixed at its second end 7 to the ball 3. The ball 3 thus hangs between the door 1 and the frame 2 by the force of gravity so that if the door is suddenly closed, the ball 3 prevents it from meeting the frame and thus protects fingers in that area. When it is desired to close and secure the door 1, the ball 3 is manually moved away from the door and frame so that it does not present an obstacle to the complete closing of said door.

In the embodiment of FIGS. 3 and 4, the mounting device comprises an arm 9 pivotally affixed to a supporting surface 10 adjacent the frame 2 of the door 1 by any suitable means such as, for example, a pivot pin 11. The arm 9 has spaced opposite first and second ends 12 and 13. The ball 4 is affixed to the arm 9 at the first end 12 thereof. The arm 9 is caused to move at the second end 13 thereof by the action of a spring 14 and move the ball 4 into position between the door 1 and the frame 2 in order to protect unsuspecting fingers in the event that the door is suddenly closed. The arm 9 is movable at the second end 13 thereof to selectively move the ball 14 out of position between the door 1 and the frame 2 when it is desired to close and secure the door.

While the invention has been described by means of specific examples and in specific embodiments, I do not wish to be limited thereto, for obvious modifications will occur to those skilled in the art without departing from the spirit and scope of the invention.

I claim:

1. A sliding door safety device for a sliding door slidably mounted in a door frame having a track slidably accommodating the door, said safety device comprising a resilient ball; and mounting means affixed to the door frame and supporting the ball in a manner whereby the ball is positionable in spaced relation with the door and the frame when the door is closed thereby permitting the door to be securely closed and is interposed between the door and the frame when the door is open thereby preventing the door from closing and protecting the fingers of unsuspecting people from being crushed between the door and the frame, said mounting means comprising a bell crank arm pivotally affixed intermediate the ends to a supporting surface adjacent the frame and having spaced opposite first and second ends, said ball being affixed to the arm at the first end thereof, a spring affixed at one end to said supporting surface and at its other end intermediate said arm, and said arm being movable by the action of the spring at the second end thereof to selectively move the ball into position between the door and the frame.

* * * * *